US005394053A

United States Patent [19]

Yun

[11] Patent Number: 5,394,053

[45] Date of Patent: Feb. 28, 1995

[54] ELECTRON GUN FOR A COLOR CATHODE RAY TUBE

[75] Inventor: Neung-yong Yun, Seoul, Rep. of Korea

[73] Assignee: Samsung Electron Devices, Kyungki, Rep. of Korea

[21] Appl. No.: 992,872

[22] Filed: Dec. 17, 1992

[30] Foreign Application Priority Data

Dec. 17, 1991 [KR] Rep. of Korea ..... 91-23271

[51] Int. Cl.[6] ..... H01J 29/51

[52] U.S. Cl. ..... 313/414; 313/412; 313/432; 313/439; 313/460; 315/308.15; 315/15; 315/382

[58] Field of Search ..... 313/414, 428, 432, 437, 313/439, 444, 460, 412; 315/15, 368.15, 382, 382.1

[56] References Cited

U.S. PATENT DOCUMENTS 4,737,682 4/1988 Alig et al. ..... 313/414
4,772,827 9/1988 Osakabe ..... 313/414 X
4,825,120 4/1989 Takahashi ..... 313/414
4,967,120 10/1990 Katsuma et al. ..... 313/414 X
5,142,190 8/1992 Kon ..... 313/414
5,212,423 5/1993 Niguchi et al. ..... 313/414

*Primary Examiner*—Donald J. Yusko
*Assistant Examiner*—Ashok Patel
*Attorney, Agent, or Firm*—Leydig, Voit & Mayer

[57] ABSTRACT

An electron gun for a color cathode ray tube having sequentially formed a cathode, a control electrode, a screen electrode, a focus electrode and a final accelerating electrode, wherein the focus electrode is constituted by first and second focus electrodes. The first focus electrode includes an evenly formed electron beam inlet plane and an electron beam outlet plane in which a portion for shaping a central electron beam passing hole is formed convexly in respect to portions for shaping outer electron beam passing holes, while the second focus electrode comprises an evenly formed electron beam outlet plane and an electron beam inlet plane in which a portion for shaping a central electron beam passing hole is formed concavely in respect to portions for shaping outer electron beam passing holes. The quadruple lens formed between outer electron beam passing holes is formed asymmetrically, to improve the convergence characteristic.

7 Claims, 2 Drawing Sheets

ELECTRON GUN FOR A COLOR CATHODE RAY TUBE

BACKGROUND OF THE INVENTION

The present invention relates to an electron gun for a color cathode ray tube, and more particularly to an in-line electron gun for a color cathode ray tube, having an improved focus electrode forming a quadruple lens.

An electron gun for a cathode ray tube is installed in a neck portion of a funnel connected to a panel and emits an electron beam to collide with a fluorescent layer. The general structure of the electron gun is as shown in FIG. 1.

A cathode 11, a control electrode 12 and a screen electrode 13 which constitute a triode, and a focus electrode 14 and a final accelerating electrode 15 which constitute a main lens, are sequentially formed in the electron gun. As shown in FIG.2A and FIG. 2B, focus electrode 14 is constituted by a first focus electrode 14*a* in which three vertically elongated electron beam passing holes 14H are formed on an outlet plane 14*c*, and a second focus electrode 14*b* in which three horizontally elongated electron beam passing holes 14H' are formed on an inlet plane 14*d*. A predetermined voltage is supplied to each electrode. A predetermined voltage Vf is supplied to first focus electrode 14*a*, and a dynamic focus voltage Vd (referenced to focus voltage Vf supplied to first focus electrode 14*a*) which is synchronous to a deflection signal, is supplied to second focus electrode 14*b*. Final accelerating electrode 15 receives an anode voltage Ve which is higher than focus voltage Vf.

As a predetermined voltage is supplied to each electrode, in a conventional color cathode ray tube constructed as above, a pre-focus lens is formed between screen electrode 13 and first focus electrode 14*a* of focus electrode 14, a quadrupole lens is formed between first focus electrode 14*a* and second focus electrode 14*b* in accordance with the supply of dynamic focus voltage Vd to second focus electrode 14*b*, and a main lens is formed between second focus electrode 14*b* and final accelerating electrode 15. Accordingly, when the electron beam emitted from cathode 11 scans the center of the screen, the quadrupole lens is not formed because there is no potential difference between first and second focus electrodes 14*a* and 14*b*, so that the electron beam emitted from cathode 11 passes through the main lens and then is landed on the center of the screen, Meanwhile, when the electron beam emitted from cathode 11 scans the periphery of the screen, a parabola-type dynamic focus voltage Vd synchronous to the deflection signal is supplied to the second focus electrode, so that a quadrupole lens is formed between first and second focus electrodes 14*a* and 14*b*, the electron beam emitted from cathode 11 is vertically elongated by the quadrupole effect when passing through the quadrupole lens. The vertically elongated electron beam passes through the main lens to be finally focused and accelerated, and then is deflected by the deflection yoke. Here, the electron beam is compensated so as to revert back to the circular shape by a non-uniform magnetic field, to scan the periphery of the fluorescent film. However, in such a conventional electron gun, a distorted electron beam is compensated by a non-uniform magnetic field of the deflection yoke, but since three in-line quadrupole lens are mutually interfered, a convergence characteristic is not good. Therefore, the resolution of a cathode ray tube having a conventional electron gun as above, becomes deteriorated.

SUMMARY OF THE INVENTION

The object of the present invention is to provide an electron gun for a color cathode ray tube which improves a convergence characteristic of an electron gun and minimizes the interference among three in-line electrostatic lenses, to thereby improve the resolution of the cathode ray tube.

To achieve the above object of the present invention, there is provided an electron gun for a color cathode ray tube wherein a cathode emitting red, green and blue electron beams, a control electrode, a screen electrode, a focus electrode and a final accelerating electrode, each of which have electron beam passing holes, are sequentially arranged at predetermined distances by a supporting means, said electron gun being characterized in that said focus electrode is divided into a first focus electrode and a second focus electrode, wherein said first focus electrode comprises an electron beam inlet plane in which a portion for shaping a central electron beam passing hole and portions for shaping outer electron beam passing holes are formed evenly, and an electron beam outlet plane in which a portion for shaping a central electron beam passing hole is formed convexly in respect to portions for shaping outer electron beam passing holes, and said second focus electrode comprises an electron beam inlet plane in which a portion for shaping a central electron beam passing hole is formed concavely in respect to portions for shaping outer electron beam passing holes, and an electron beam outlet plane in which a portion for shaping a central electron beam passing hole and portions for shaping outer electron beam passing holes are formed evenly.

BRIEF DESCRIPTION OF THE DRAWINGS

Further features and advantages will become more apparent from the following and more particular description of the preferred embodiment of the invention as illustrated in the accompanying drawings in which the same reference characters generally refer to like parts throughout the views, and in which.

DETAILED DESCRIPTION OF THE INVENTION

Figure 1:
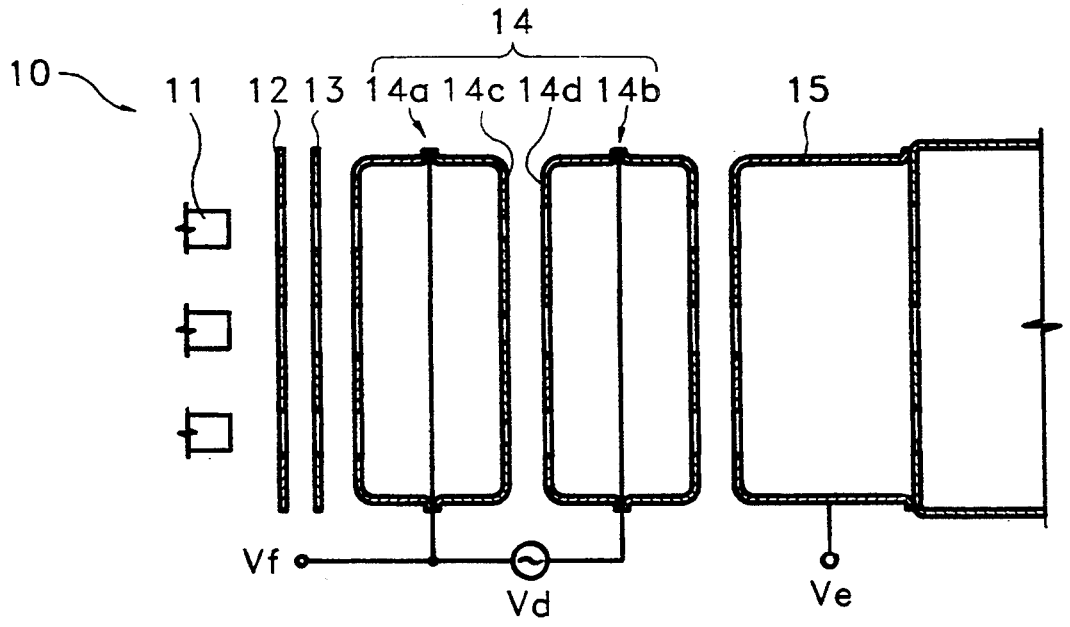
FIG. 1 (PRIOR ART)
FIG. 1 is a sectional view of a conventional electron gun for a cathode ray tube.
Figure 2A:
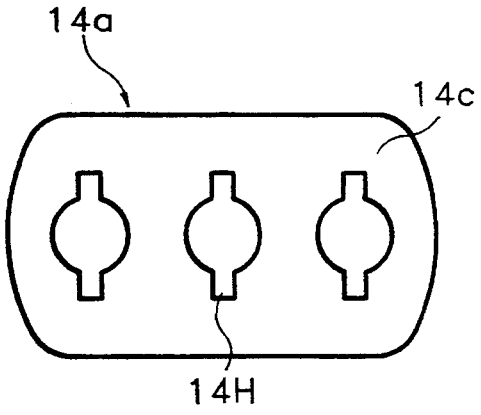
FIG. 2A (PRIOR ART)
FIG. 2A shows an electron beam outlet plane of the first focus electrode of FIG. 1.
Figure 2B:
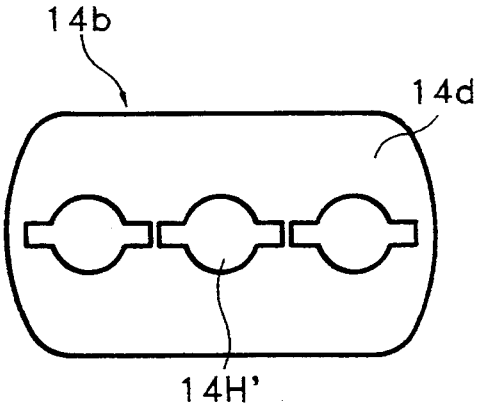
FIG. 2B (PRIOR ART)
FIG. 2B shows an electron beam inlet plane of the second focus electrode of FIG. 1.
Figure 3:
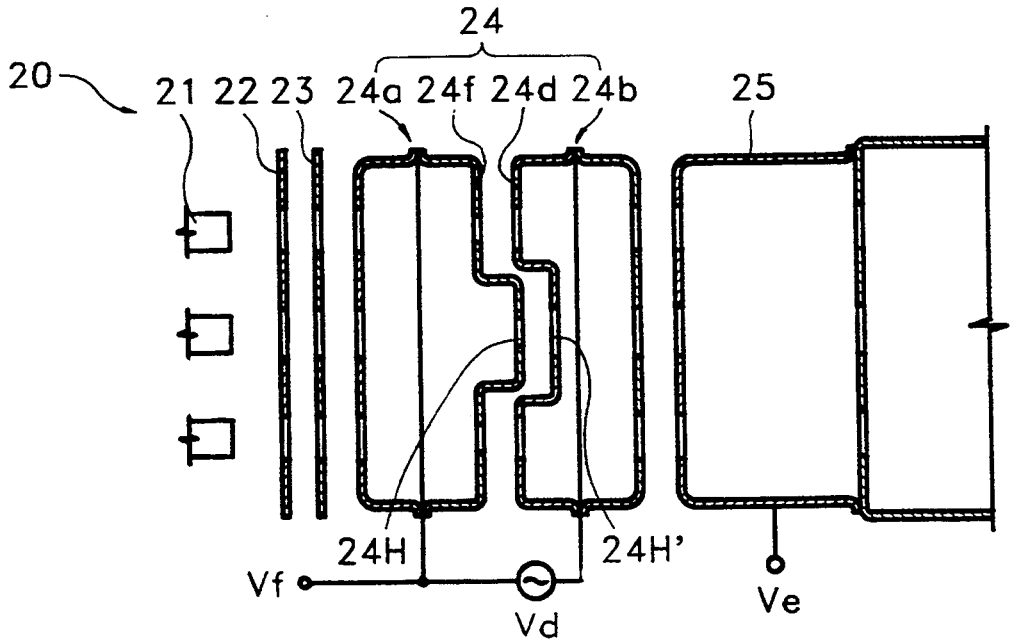
FIG. 3 is a sectional view of an electron gun for a color cathode ray tube according to the present invention.

As shown in FIG. 3, an electron gun 20 for a color cathode ray tube is constituted by a cathode 21, a control electrode 22 and a screen electrode 23 which together constitute a triode, and a focus electrode 24 and final accelerating electrode 25 which together constitute a main lens.

Figure 4:
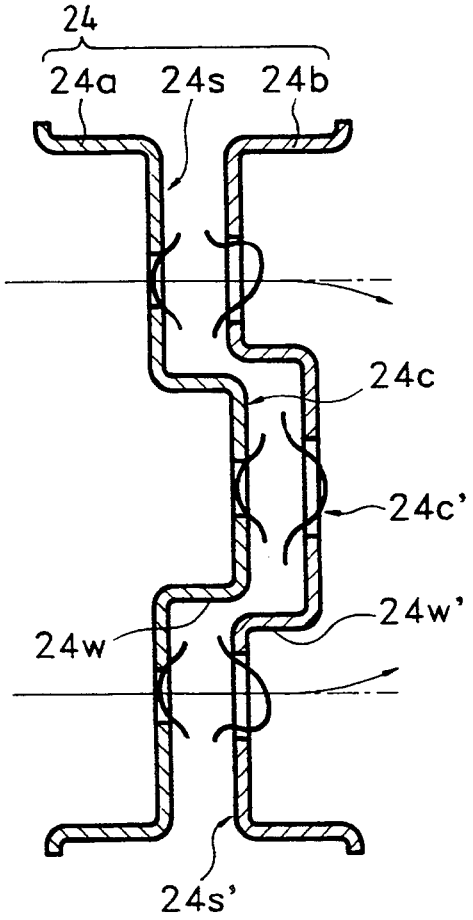
FIG. 4 shows a quadrupole lens formed between the electron beam outlet plane of a first focus electrode and electron beam inlet plane of a second focus electrode as shown in FIG. 3.

In FIG. 4, focus electrode 24 is constituted by a first focus electrode 24*a* where a vertically elongated electron beam passing hole 24H is formed on an electron beam outlet plane **24*f*, and a second focus electrode 24*b* where a horizontally elongated electron beam passing hole 4H' is formed on an electron beam inlet plane 24*d*. In electron beam outlet plane 24*f* of first focus electrode 24*a*, a portion for shaping a central electron beam passing hole 24*c* is convex in respect to portions for shaping outer electron beam passing holes 24S. In electron beam inlet plane 24*d* of second focus electrode 24*b*, a portion for shaping a central electron beam passing hole 24*c'* is concave with respect to portions for shaping outer electron beam passing holes 24S'. That is, electron beam outlet plane 24*f* of first focus electrode 24*a* has a side-wall 24W that is convex with respect to portions for shaping outer electron beam passing holes 24S, while electron beam inlet plane 24*d* of second focus electrode 24*a* has a side-wall 24W' that is concave with respect to portions for shaping outer electron beam passing holes 24S'. It is desirable that the portion for shaping a central electron beam passing hole 24*c* of first focus electrode 24*a* is slightly advanced into portion for shaping a central electron beam passing hole 24*c'* of second focus electrode 24*b*. A predetermined voltage is supplied to each electrode in such a manner that an anode voltage Ve of 25–35 kV is supplied to final accelerating electrode 25, a focus voltage Vf being 20–35% of the voltage supplied to final accelerating electrode 25 is supplied to first focus electrode 24*a* of focus electrode 24, and a parabola-type dynamic focus voltage Vd higher than focus voltage Vf by as much as 0.5–1 kV is supplied to second focus electrode 24*b*** in synchronization with the deflection signal.

The electron gun for a color cathode ray tube of the present invention constructed as above is operated as follows.

As a predetermined voltage is supplied to each electrode which constitutes electron gun 20 for a color cathode ray tube, a pre-focus lens is formed between screen electrode 23 and first focus electrode **24*a*, a quadrupole lens is formed between first focus electrode 24*a* and second focus electrode 24*b* in accordance with the supply of dynamic focus voltage Vd, and a main lens is formed between second focus electrode 24*b* and final accelerating electrode 25**.

When the electron beam emitted from cathode 21 scans on the center of the screen, a parabola-type dynamic focus voltage Vd synchronous to the deflecting signal is not supplied to second focus electrode **24*b*, so that the quadrupole lens is not formed between first focus electrode 24*a* and second focus electrode 24*b*. Accordingly, the electron beam emitted from cathode 21 is preliminarily focused and accelerated in the pre-focus lens and then is finally focused and accelerated in the main lens, to be landed on the center of the fluorescent layer. At this time, since portion for shaping a central electron beam passing hole 24*c'* formed on electron beam inlet plane 24*d* of second focus electrode 24*b* is inwardly concaved, the electron beams passing through the outer electron beam passing holes are moved toward the central electron beam, That is, the outer electron beam emitted from cathode 21 is moved toward the central electron beam passing hole by side-wall 24W' of the portion for shaping a central electron beam passing hole 24*c* formed on the electron beam inlet plane of second focus electrode 24*b*** where a focus voltage having a positive potential is supplied.

When the electron beam emitted from cathode 21 is deflected to the periphery of the screen, parabola-type dynamic focus voltage Vd synchronous to the deflection signal is supplied to second focus electrode **24*b*, so that a quadrupole lens is formed between electron beam outlet plane 24*f* of first focus electrode 24*a* having vertically elongated electron beam passing hole 24H, and electron beam inlet plane 24*d* of second focus electrode having horizontally elongated electron beam passing hole 24H'. The quadrupole lens formed by the central electron beam passing holes is symmetrically formed with the electron beam proceeding line, but the quadrupole lens formed by the outer electron beam passing holes is asymmetrically formed by side-wall 24W' of the portion for shaping a central electron beam passing hole 24*c'*. That is, since the electric field formed in the edges of the outer electron beam passing holes of first and second focus electrodes 24*a* and 24*b*, and in side-walls 24W and 24W' is not uniform, the quadrupole lens made by the equipotential line is asymmetrically formed in respect to the electron beam proceeding line. Accordingly, the electron beam emitted from cathode 21** is preliminarily focused and accelerated in the pre-focus lens, and secondly focused and accelerated in the quadrupole lens, and then finally focused and accelerated in the main lens to land on the fluorescent layer. Since the quadrupole lens formed by the outer electron beam passing holes is asymmetrically formed described as above, the electron beam having passed through this quadrupole lens is converged toward the central electron beam passing hole, and the section of each electron beam is vertically elongated. Since the magnitude of the electron beam changes in accordance to the dynamic focus voltage which is synchronous to the deflection signal, the electron beam's convergence characteristic will be in the optimum condition when the electron beam scans the periphery of the fluorescent film. Particularly, the electron beam which is vertically elongated when passing through the quadrupole lens, is compensated so as to revert back to the circular shape by a non-uniform magnetic field of the deflection yoke during deflection by the deflection yoke, thereby optimally landing on the fluorescent film.

In the electron gun for a color cathode ray tube of the present invention, the portion for shaping a central electron beam passing hole placed on the electron beam outlet plane of the first focus electrode is formed convexly, and the portion for shaping a central electron beam passing hole placed on the electron beam inlet plane of the second focus electrode, is formed concavely. Therefore, the quadrupole lens formed by the outer electron beam passing holes is formed asymmetrically, so that the convergence characteristic of the electron beam is improved, and the interference between three in-line electrostatic lenses is minimized, to thereby improve the resolution of the cathode ray tube having this electron gun.

Having described a preferred embodiment of the present invention, it will be clear to those skilled in the art that modifications and alternatives to the disclosed apparatus exist within the scope and spirit of the present invention. Accordingly, it is intended to limit the scope of the present invention only as indicated in the following claims.

What is claimed is:

1. An electron gun for a color cathode ray tube comprising:

a cathode emitting red, green and blue electron beams, a control electrode, a screen electrode, a focus electrode and a final accelerating electrode, each of said screen, control and focus electrode having three in-line electron beam passing holes, [are sequentially arranged at predetermined distances by a supporting means, said electron gun said focus electrode including a first member having an electron beam inlet plane including three in-line electron beam passing holes and said focus electrode including a second member having an electron beam outlet plane including three in-line electron beam passing holes, wherein the electron beam inlet plane of the first member includes a central housing portion having a central electron beam passing hole, the central portion of the first member being convex with respect to outer portions of the first member and the electron beam outlet plane of the second member including a central housing portion having a central electron beam passing hole, the central portion of the second member being concave with respect to outer portions of the second member.

2. An electron gun for a color cathode ray tube as claimed in claim 1, wherein said central and outer electron beam passing holes of the first member are vertically elongated, and said central and outer electron beam passing holes of the second member are horizontally elongated.

3. An electron gun for a color cathode ray tube as claimed in claim 1, wherein the central portion of the electron beam outlet plane of the second member is slightly advanced into the central portion of the electron beam inlet plane of the first member.

4. An electron gun of a color cathode ray tube comprising:

a cathode emitting red, green and blue electron beams, a control electrode, a screen electrode, a focus electrode and a final accelerating electrode, each of said screen, control and focus electrodes having three in-line electron beam passing holes, at said focus electrode including a first member receiving a focus voltage and a second member receiving a parabola-type dynamic focus voltage which is synchronized with a deflection signal, the first member including (1) an electron beam inlet plane having three in-line electron beam passing holes and (2) an electron beam outlet plane having three in-line electron beam passing holes and having a central portion housing a central one of the three in-line electron beam passing holes, the central portion being convex with respect to outer portions of the electron beam outlet plane, and the second member including (1) an electron beam inlet plane having three in-line electron beam passing holes and having a central portion housing a central one of the three in-line electron beam passing holes, the central portion being concave with respect to outer portions of the electron beam inlet plane, and (2) an electron beam outlet plane having three in-line electron beam passing holes.

5. An electron gun for a color cathode ray tube as claimed in claim 4, wherein the central and outer electron beam passing holes formed on the electron beam outlet plane of the first member are vertically elongated, and the central and outer electron beam passing holes formed on the electron beam inlet plane of the second member are horizontally elongated.

6. An electron gun for a color cathode ray tube as claimed in claim 4, wherein the central portion of the electron beam outlet plane of the first member is slightly advanced into the central portion of the electron beam inlet plane of the second member.

7. An electron gun for a color cathode ray tube as claimed in claim 4, wherein a predetermined voltage is supplied to each electrode such that an anode voltage Ve of 25–35 kV is supplied to said final accelerating electrode, a focus voltage Vf being 20–35% of the voltage supplied to said final accelerating electrode is supplied to the first member of said focus electrode, and a parabola-type dynamic focus voltage Vd higher than focus voltage Vf by as much as 0.5–1 kV is supplied to the second member of said focus electrode in synchronization with the deflection signal.

* * * * *

UNITED STATES PATENT AND TRADEMARK OFFICE

CERTIFICATE OF CORRECTION

PATENT NO. : 5,394,053

DATED : February 28, 1995

INVENTOR(S) : Neung-yong Yun

It is certified that error appears in the above-indentified patent and that said Letters Patent is hereby corrected as shown below: Title page:

Item [56], U.S. Patent Documents, line 6, delete "Niguchi"

insert --Noguchi--.

Column 27, line 38, delete "at".

Signed and Sealed this

Twentieth Day of June, 1995

Bruce Lehman

*Attest:*

BRUCE LEHMAN

*Attesting Officer*

*Commissioner of Patents and Trademarks*